United States Patent [19]

Nakashima

[11] Patent Number: 4,727,833

[45] Date of Patent: Mar. 1, 1988

[54] SEALING STRUCTURE OF CYLINDER HEAD COVER

[75] Inventor: Mikio Nakashima, Okazaki, Japan

[73] Assignee: Toyota Jidosha Kabushiki Kaisha, Aichi, Japan

[21] Appl. No.: 930,303

[22] Filed: Nov. 12, 1986

[30] Foreign Application Priority Data

Nov. 18, 1985 [JP] Japan ..... 60-176186[U]

[51] Int. Cl.[4] ..... F02F 7/00

[52] U.S. Cl. ..... 123/195 C; 123/198 E

[58] Field of Search ..... 123/193 H, 198 E, 195 C

[56] References Cited

U.S. PATENT DOCUMENTS

| | | | |
|---|---|---|---|
| 3,144,013 | 8/1964 | Peras | 123/260 |
| 3,521,726 | 7/1970 | Freyn | 123/195 C |
| 4,338,889 | 7/1982 | Kirchweger et al. | 123/195 C |
| 4,495,903 | 1/1985 | Asano | 123/195 C |

FOREIGN PATENT DOCUMENTS

| | | |
|---|---|---|
| 53-153107 | 12/1978 | Japan . |
| 54-31716 | 3/1979 | Japan . |
| 60-167144 | 11/1985 | Japan . |
| 61-23595 | 2/1986 | Japan . |

*Primary Examiner*—Charles J. Myhre
*Assistant Examiner*—David A. Okonsky
*Attorney, Agent, or Firm*—Kenyon & Kenyon

[57] ABSTRACT

A structure for mounting a cylinder head cover on an engine cylinder head, having plug holes for mounting ignition plugs. A plug tube is fixedly inserted into each plug hole and the cylinder head cover is mounted on the cylinder head via a sealing gasket. The cylinder head cover has mount holes, each of which is formed in a reverse-conical surface. A grommet having an annular sealing lip is fitted to the upper end of the plug tube and a fastening nut is engaged with a male thread portion of the plug tube to urge the grommet downward so that the sealing lip is sealingly engaged with the reverse-conical face of the cylinder head cover and an outer peripheral surface of the plug tube, so as to tightly seal away oil contained in the cylinder head cover.

4 Claims, 2 Drawing Figures

SEALING STRUCTURE OF CYLINDER HEAD COVER

BACKGROUND OF THE INVENTION

1. Field of the Invention

This invention relates to a structure of a cylinder head cover for an internal combustion engine, and more particularly, to an oil sealing structure of the cylinder head cover mounting portion in an engine having a plug tube for inserting an ignition plug.

2. Description of the Related Art

In an internal combustion engine for motor vehicles in the prior art, a problem has arisen in that lubricant oil is heavily dispersed in a cylinder head cover, and this sometimes causes an oil leakage from a fastening portion of the cylinder head cover to occur, due to various requirements such as a high speed and high performance. A problem has also arisen, especially in an overhead camshaft type engine, that noise is transmitted from the cylinder head cover. Therefore, a sealing gasket is conventionally disposed on a surface abutting between the cylinder head cover and a cylinder head so that the gasket provides a surface sealing by fastening the cylinder head cover to the cylinder head so as to give a uniform pressure to the abutting surface.

In a known art for mounting a cylinder head cover on a cylinder head, a structure is disclosed in which several stud bolts are fixed on the upper surface of the cylinder head so that the cylinder head cover can be rigidly mounted on the cylinder head by tightening several nuts on the corresponding stud bolts, as described in, for example, Japanese Unexamined Utility Model publication No. 54-31716. Another structure is also known in which a cylinder head cover is supported by a rocker support member, as disclosed in, for instance, Japanese Unexamined Utility Model publication No. 53-153107. In an engine having a plug tube, it is also known that a sealing packing is disposed between the plug tube and a cylinder head cover, as disclosed in U.S. Pat. No. 3,144,013.

The applicant (or assignee) of this invention has proposed in earlier filed applications that, in an engine having a plug tube, the sealing characteristics between the plug tube and a cylinder head cover can be improved (Japanese Utility Model application No. 59-54676), and that the fastening and sealing of a cylinder head cover can also be improved (Japanese Utility Model application No. 59-108171).

SUMMARY OF THE INVENTION

An object of the present invention is to provide an oil sealing structure of a cylinder head cover mounting portion in an internal combustion engine having a plug tube, in which a cylinder head cover is fastened in such a manner that the pressure on an abutting surface between the cylinder head cover and a cylinder head can be made uniform with a simple and compact structure, and oil sealing at the fastening portion, and the durability of a grommet, can be improved.

According to the present invention, there is provided a structure for mounting a cylinder head cover on a cylinder head of an internal combustion engine, the cylinder head having plug holes for mounting ignition plugs therethrough, a plug tube fixedly inserted into each of the plug holes and protruding upward from the cylinder head, and the cylinder head cover mounted on the cylinder head via a sealing gasket arranged therealong, wherein said mounting structure comprises: a cylinder head cover having mount holes, each of which is formed with a substantially reversed-conical surface having a gradually smaller diameter toward the lower portion thereof, the plug tube having a male thread portion at an upper end thereof protruding upward from the cylinder head cover through the mount hole, a grommet having an annular sealing lip fitted to the upper end of the plug tube, and a fastening nut engaged with and fastened to the male thread portion of the plug tube to urge the grommet downward so that the sealing lip of the grommet is sealingly pressed into a gap between the reversed-conical surface of the cylinder head cover and an outer peripheral surface of the plug tube, to tightly seal oil contained in the cylinder head cover.

The sealing lip of the grommet is forcibly inserted between the reversed-conical surface of the mounting hole and the outer surface of the plug tube, at the same time that the cylinder head cover is mounted on the cylinder head. Therefore, the plug tube is effectively sealed from the upper side of the cylinder head cover. Accordingly, the oil sealing capacity as well as vibration preventing characteristics are improved with a simple structure.

DESCRIPTION OF THE PREFERRED EMBODIMENT

Figure 1:
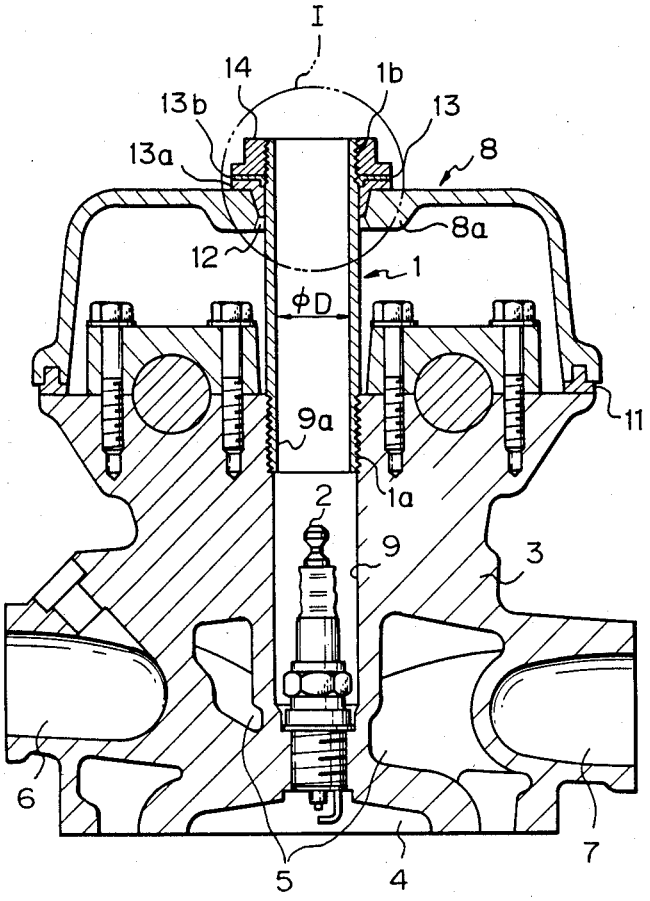
FIG. 1 is a cross-sectional view of a cylinder head of an internal combustion engine employing a cylinder head cover fastening structure according to the present invention.

Referring now to FIG. 1, reference numeral 1 denotes a plug tube; 2, an ignition plug; 3, a cylinder head; 4, an engine combustion chamber; 5, a cooling water gasket; 6, an intake port; and 7, an exhaust port. Intake and exhaust valves and their valve seats are not shown in this drawing.

The cylinder head 3 is provided with a plug hole 9 for mounting the ignition plug 2 on the cylinder head 3. The plug hole 9 is provided with a female thread 9*a* at an upper portion thereof. On the other hand, the plug tube 1 made of, for example, a pipe and the like, has male thread portions 1*a* and 1*b* at the respective ends thereof, so that it is fixedly engaged at one end 1*a* thereof with the female thread 9*a* of the plug hole 9. The plug tube 1 has an inner diameter $\phi D$ such that a plug insert tool (not shown) can be inserted therein to insert or remove the ignition plug 2.

The structure for fixing the plug tube 1 to the plug hole 9 may be any type other than that mentioned above and shown in FIG. 1. For example, the plug tube 1 may be extended downward to the bottom of the plug hole 9 so that the plug tube 1 is rigidly secured thereto by the ignition plug 2 per se.

The cylinder head cover 8 is provided with a sealing gasket 11 along the periphery and at an upper portion thereof, corresponding to the plug tube 1, with a tube mounting hole 12. Four or six such tube mounting holes 12 are provided for a four or six cylinder engine, respectively.

Figure 2:
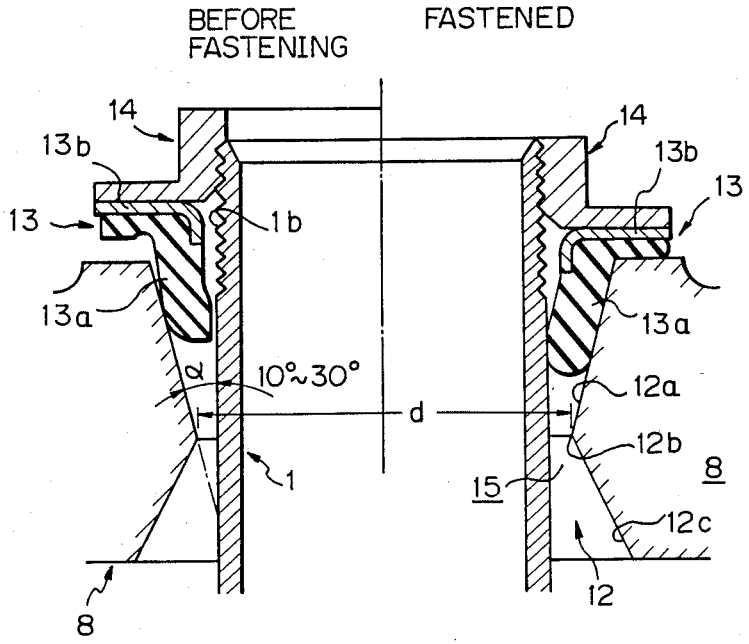
FIG. 2 is an enlarged cross-sectional view of the portion indicated by I in FIG. 1 and illustrating a fastening sealing structure according to the present invention.

As illustrated in detail in FIG. 2, the tube mounting hole 12 is formed substantially in a reverse-conical shape 12*a*. Consequently, the diameter thereof is gradually decreased toward the lower portion thereof. The portion lower than a minimum diametrical portion 12*b* thereof is formed in a conical shape 12*c*, in which the diameter thereof is gradually increased toward the lower portion. The cylinder head cover 8 is mounted on the cylinder head 3 in such a manner that the tube mounting hole 12 accommodates the plug tube 1. Namely, the plug tube 1 is fixed to the plug hole 9 after the cylinder head cover 8 is mounted on the cylinder head 3. In this state, the sealing gasket 11 on the cylinder head cover 8 is in sealing contact with the upper surface of the cylinder head 3, and the upper end of the plug tube 1 protrudes upward from the tube mounting hole 12. Then, a sealing grommet 13 is fitted to the plug tube 1 from above to tightly seal the clearance between the plug tube 1 and the cylinder head cover 8. A fastening nut 14 is also engaged with the male thread portion 1*b* of the plug tube 1 to fixedly secure the grommet 13 thereto. The grommet 13 comprises a sealing annular rubber lip 13*a* which is adhered by vulcanizing to a metal ring 13*b*. The rubber lip 13*a* is formed substantially in an L-shape in axial cross-section and elongated in the direction away from the metal ring 13*b*. Consequently, the lower portion of the rubber lip 13*a* is elongated downward and inward, so that the top end of the rubber lip 13*a* is compressed against the reverse-conical surface 12*a* of the mounting hole 12 and comes into focible contact with the outer peripheral surface of the plug tube 1, with the help of the fastening nut 14.

The angle $\alpha$ of the reverse-conical surface 12*a* of the mounting hole 12 is preferably selected within the range of 10° to 30° in order to prevent an excess deformation of the grommet 13. The inner diameter D of the minimum portion 12*b* of the mounting hole 12 is preferably as small as possible so that a clearance 15 to the plug tube 1 can be made as small as possible to prevent oil in the cylinder head cover 8 from being dispersed toward the grommet 13.

According to the present invention, the cylinder head cover 8 is mounted on the cylinder head 3 by fastening it at four or six positions on the upper surface thereof, for a four or six cylinder engine, respectively. At the same time, the sealing rubber lip 13*a* of the grommet 13 is forcibly inserted between the reverse-conical surface 12*a* of the mounting hole 12 and the outer surface of the plug tube 1, so that, after fastening, the contact area between the rubber lip 13*a* and the reverse-conical surface 12*a* is especially enlarged so as to improve the oil sealing capacity as well as the vibration preventing characteristics thereof. The clearance 15 is so small that the grommet 13 is not directly exposed to the influence of high temperature lubricant oil in the cylinder head cover 8. Therefore, the rubber material of the lip portion 13*a* (the rate of compression) is prevented from deteriorating and its sealing characteristics are preferably maintained for long period of use.

I claim:

1. A structure for mounting a cylinder head cover on a cylinder head of an internal combustion engine, the cylinder head having plug holes for mounting ignition plugs therethrough, a plug tube fixedly inserted into each of the plug holes and protruding upward from the cylinder head, the cylinder head cover being mounted on the cylinder head via a sealing gasket arranged therealong, wherein said mounting structure comprises:

the cylinder head cover having plug mounting holes, each of which is formed in substantially reversed-conical surface having a diameter that becomes gradually smaller toward the lower portion thereof, the plug tube having a male thread portion at an upper end thereof protruding upward from the cylinder head cover through the plug mounting hole, a grommet having an annular sealing lip fitted to the upper end of the plug tube, and a fastening nut engaged with and fastened to a male thread portion of the plug tube to urge the grommet downward so that said sealing lip of the grommet is sealingly pressed into a gap between the reverse-conical surface of the cylinder head cover and an outer peripheral surface of the plug tube, so as to tightly seal away oil contained in the cylinder head cover.

2. A structure as set forth in claim 1, wherein the reverse-conical surface of the plug mounting hole of the cylinder head cover has an angle of 10° to 30° in axial cross-section with respect to an axial direction.

3. A structure as set forth in claim 1, wherein the grommet comprises a metal ring to which the annular sealing lip made of rubber is vulcanizingly adhered.

4. A structure as set forth in claim 3, wherein the annular rubber sealing lip is formed substantially in an L-shape in the axial cross-section thereof such that a lower portion thereof opposite to the metal ring is elongated downward to sealingly engage with the reverse-conical surface of the cylinder head cover and the outer peripheral surface of the plug tube.

* * * * *